United States Patent [19]

Bungeroth et al.

[11] Patent Number: 4,697,631

[45] Date of Patent: Oct. 6, 1987

[54] PROCESS FOR THE PRODUCTION OF AN INGOT

[75] Inventors: Herbert Bungeroth, Duesseldorf; Otto Wessel, Duisburg, both of Fed. Rep. of Germany

[73] Assignee: Mannesmann Aktiengesellschaft, Duesseldorf, Fed. Rep. of Germany

[21] Appl. No.: 812,379

[22] Filed: Dec. 23, 1985

[30] Foreign Application Priority Data

Dec. 21, 1984 [DE] Fed. Rep. of Germany ..... 3447557
May 14, 1985 [DE] Fed. Rep. of Germany ..... 3517691

[51] Int. Cl.[4] ..... B22D 23/00

[52] U.S. Cl. ..... 164/46; 164/459; 164/479; 419/1; 419/38; 419/66

[58] Field of Search ..... 164/46, 459, 479; 419/1, 66, 38

[56] References Cited

U.S. PATENT DOCUMENTS

| | | | |
|---|---|---|---|
| 4,066,117 | 1/1978 | Clark et al. | 164/46 |
| 4,515,204 | 5/1985 | Ohno | 164/459 |
| 4,605,056 | 8/1986 | Ohno | 164/440 |

*Primary Examiner*—Stephen J. Lechert, Jr.
*Attorney, Agent, or Firm*—Oblon, Fisher, Spivak, McClelland, & Maier

[57] ABSTRACT

In a process and apparatus for forming an ingot having a length at least twice as great as its characteristic sectional dimension, droplets of molten metal are sprayed onto a catching surface of a dummy bar which is rotated about its axis and moved in a removal direction along its axis. Layers of spray built up on the catching surface form an ingot. Boundary surfaces may be provided for shaping one of the surfaces of the formed ingot. In the case of a hollow ingot, the boundary surfaces are in the form of a partially cylindrical mandrel extending axially into a hollow dummy bar.

14 Claims, 5 Drawing Figures

(A-A)

PROCESS FOR THE PRODUCTION OF AN INGOT

BACKGROUND OF THE INVENTION

1. Field of the Invention

The invention relates to a process and an apparatus for the production of an ingot, which can have a solid or a hollow shape, by spraying a molten metal by use of a pressurized gas and catching the spray particles on a catching surface. The ingot is formed as a continuous agglomerate of the spray particles. As a semifinished product, such an ingot is further processed into wires, tubes or other shapes.

2. Related Art

Ingots are normally produced by pouring into ingot molds and subsequent rolling or by continuous casting.

According to a process known from DE-PS No. 22 52 139, molded articles, e.g., flat disks for forgings are produced by spraying molten metal by used of pressurized gas and collecting the spray particles on a form. The process has special advantages because segregations and casting structures are avoided in the production preforms and therefore difficult alloys can be processed into formed pieces. This procedure in most cases permits a reduction in the number of forming stages necessary to produce the ultimate product in comparison with conventional production methods.

Production of ingots, e.g., for the production of tubes, by catching the spray particles on a cylindrical form has already been proposed. In the spray process thus far known, however, the producible ingot length has been greatly limited because with greater lengths the distance of the catching surface from the spray nozzle during the spray process changes too greatly and the conditions for the flow of the spray gas and for cooling the spray particles become too unfavorable. Therefore ingots whose length is at least twice that of its characteristic cross-sectional dimension (e.g., diameter or diagonal) cannot, or can only conditionally, be produced according to this known process.

Also known is the production of hollow cylinders, e.g., in the form of thick-walled hollow ingots as semifinished products (rough-pierced tube blanks) for tube production with varying wall thicknesses by spraying molten metal in small droplets and catching the spray particles on a rotatable cylindrical mandrel that can be shifted in its longitudinal direction (GS-PS No. 1 599 392). The thickness of the sprayed-on layer, i.e., the wall thickness of the resulting hollow cylinder depends on the amount of the molten metal sprayed per unit of time and on the speed of the rotary and longitudinal movement of the mandrel. The relative thickness of the sprayed-on layer can amount to 100% of the entire thickness of the final product but may also be smaller. The hollow cylinders thus produced are suitable for hot working (e.g., extrusion) or—with full thickness—directly for cold working (e.g., cold pilger rolling). Compared to the usuaul process, this process offers especially the following advantages over casing:

1. No segregation or separations,
2. Fewer forming steps required (energy and material saving),
3. No casting structure (better deformation), and
4. Production of "exotic" alloys is possible.

However, this known spary process has one significant disadvantage: the rotatable mandrel that can be moved longitudinally must have a surface to which the sprayed-on particles adhere, so that they do not fall of the mandrel during the rotation. But as a result of this, following the spray process, the mandrel cannot be pulled out of the formed hollow cylinder which, moreover has shrunk on during cooling. If the mandrel consists of a brittle material, e.g., ceramic, it must be crushed and its fragments must be completely removed, which entails considerable expense.

If the mandrel is made, e.g., of sheet steel, there is the danger that it will be deformed by the high temperature of the resulting molten metal particles. In this case, too, its mandatory removal prior to the finishing process is a costly matter.

SUMMARY OF THE INVENTION

The object of the present invention is to avoid these disadvantages.

The invention uses molten metal sprayed in small particles by pressurized gas in a manner known from the prior art. These spray particles are caught in a device having a catching surface that is subject to rotation and a simultaneous longitudinal movement (in the sense of a removal movement, i.e., away from the spray) in the direction of the axis of rotation. It is preferred to set the axis of rotation inclined at an angle that is greater than 90° and smaller than 180° in relation to the direction of the center of the spray jet. Because of the rotation, the impact zone of the spray jet constantly moves over the catching surface and forms a continuous agglomerate of spray particles growing in layers. The shaping of the formed surface areas which extend in the longitudinal direction of the resulting ingot is accomplished by using the spray jet to form a free surface through control of the movement of the ingot, and additionally or alternately with the aid of at least one boundary surface which is kept basically stationary, and which is struck by part of a spray jet without the spray jet adjering to it. A basically stationary boundary surface in this connection denotes an arrangement in which the boundary surface is not moved out of the area of the spray jet; i.e., in addition to a fixed arrangement, rotation and oscillating movements (with short stroke) around a midposition are permissible.

The distance of the catching surface (i.e., the respective top layer of the spray particles) from the spray nozzle, which preferably is designed as an annular slot nozzle, is set at a desired value before the start of the spraying. By changing this distance, the porosity of the produced ingot can be influenced. The greater the distance, the more the spray particles are solidified when impacting on the catching surface, and the less they are deformed, so that the porosity increases.

To produce ingots with a uniform structured formation in a preferred embodiment of the process, the distance traveled by the spray particles, and thus their cooling conditions, remain essentially constant. The rotation and the longitudinal movement as a function of the quantity of molten metal sprayed per unit of time is so regulated that the distance of the impact zone on the catching surface from the spray nozzle remains constant. But it is also possible to deliberably change this distance during the spray process to produce zones with different structures in the ingot, in other words with different density and porosity.

At the beginning of the spray process the spray particles are caught on an area of a dummy bar which defines a "catching surface" and is preferably provided with slots and lugs to attain an interlocking connection with the agglomerate formed from the spray particles. During the further course of the spray process, the spray particles are caught by the layer precipitated during the preceding revolution, which now becomes the "catching surface".

If the cross section of the spray jet is significantly smaller than the cross section of the ingot to be produced and/or if the ingot cross section is not circular but is polygonal (e.g., square), the catching surface must execute oscillating movements transverse to the direction of the spray jet, so that the impact zone of the spray jet covers the entire catching surface. This may be done by oscillating a carriage upon which the dummy bar is mounted.

By setting an angle $\alpha$ between the direction (axis) of the spray jet and the axis of rotation of the catching surface, and providing an oscillating movement, a desired ingot cross section can be produced with a preset cross section of the spray jet.

It has already been stated that the shaping of the ingot surface areas extending in the longitudinal direction of the ingot can be accomplished solely with the aid of the spray jet (i.e., free forming). The surfaces so created are distinguished by relatively great roughness. Smoother surfaces result if alternately or additionally stationary boundary surfaces whose shape is a negative image of the desired inside and/or outside form of the ingot surface in each case are used. The shaping takes place so that in each case a part of the spray jet strikes such a boundary surface without caking to the boundary surface; the remainder of the spray jet strikes the surface of the already formed agglomerate, so that there results a continuous molded article whose surface form is determined by the boundary surface. So as not to disturb the removal of the agglomerate, the boundary surfaces are to be aligned parallel to the removal (i.e., longitudinal) direction. To that extent there is some similarity to the shaping of a continuous casting.

The boundary surfaces can completely or partially surround the outside contour of the catching surface. To produce cylindrical ingots, a cylindrical section inside the ingot may be used. It is essential in each case to keep the boundary surface basically stationary. As already mentioned, this does not mean absolutely fixed; rather, the boundary surface is not moved longitudinally with the resulting ingot, and to that extent is stationary. However, it can be advantageous to permit the boundary surface to oscillate with a slight stroke (e.g., 3 mm) around a midposition to prevent caking of the agglomerate on the boundary surface. This oscillating movement takes place in the direction of the axis of rotation of the catching surface (i.e., removing direction) in the production of a cylindrical ingot, there can also be carried out a rotation of the boundary surface (e.g., by a 5°–10° angle) around the axis of rotation of the catching surface.

With the process according to the invention, not only can solid ingots of any cross sectional form be produced, but also ingots with a hollow shape. In this case, for the forming of the inside surface, a boundary surface in the form of a mandrel is held in a stationary position, in other words is not moved together with the developing agglomerate. But the mandrel can perform limited oscillating longitudinal and/or rotary movements (the latter only in the case of a cylindrical inside surface) in relation to the axis of rotation of the catching surface to prevent caking of the agglomerate. In the production of ingots with noncylindrical inside surfaces the mandrel, whose surface—insofar as its serves for shaping—corresponds to a negative image of the inside surface of the hollow ingot, must rotate with the formed agglomerate, so that longitudinal movement of the ingot (i.e., removal) is not blocked. Removal can be facilitated by designing the mandrel to be slightly conical in the direction of removal.

In the production of hollow ingots with cylindrical inside surfaces, a mandrel is advantageously used whose surface is formed cylindrically only in a section, namely on the side facing the spray jet. The partial cylindrical surface of the mandrel extends—viewed in axial cross section—by a circular section with an angle of less than 180°. The other surface areas of the mandrel, insofar as they are to the side of the agglomerate to be removed, can be made, e.g., with a plane surface (prismatic); they must not extend beyond the imaginary cylinder having surface 28, and thus remain within the cylinder corresponding to the inside surface of the hollow ingot. This mandrel shape prevents the forming agglomerate from shrinking onto the mandrel.

While the spray jet strikes the cylindrical part of the mandrel, the already formed agglomerate is removed in a continuous helical removal movement. Thus the agglomerate is removed from the mandrel not only in a longitudinal movement, but at the same time is also rotated around the longitudinal axis of the mandrel. Thus constant "growth" of the metallic hollow cylinder is guaranteed because part of the spray jet constantly strikes the already hardened head part of the deposit and combines with it. To facilitate the start of the process, it is recommended to press an essentially cylindrical dummy bar over the mandrel, the dummy bar (or a head piece thereof) initially serving as a catching surface. The outside diameter of the dummt bar should correspond to the outside diameter of the produced hollow cylinder. To make pressing the dummy bar onto the mandrel possible, the dummy bar must be tubular at least at one end, whereby the inside diameter of the tube corresponds to the inside diameter of the hollow cylinder to be produced. At the beginning of the process, the spray jet is directed at the head piece of the dummy bar, so that the molten metal particles combine with this part of the dummy bar. Thus it is possible without any difficulty to transfer the removal movement to the developing deposit on the mandrel.

It is advantageous to bevel the dummy bar in the head area conically on the outside. It may also be useful to provide slots or lugs in this beveled area to ensure an interlocking connection of the dummy bar with the produced deposit. This head part of the dummy bar ought to be designed to be easily replaceable since it must be separated from the produced hollow cylinder prior to the further processing of the hollow cylinder.

Since the forming ingot must not adhere to the boundary surfaces but must slide over these surfaces in the removal movement, it is advantageous to coat these surfaces, e.g., with hard metal or with ceramic or also to sputter it with hard materials (e.g., titanium nitride, titanium oxide, aluminum oxide). The boundary surfaces should at least be hardened and thus possess increased wear resistance so that their roughness can remain low as long as possible. It is also helpful to cool the boundary surfaces. For this purpose appropriate cooling ducts for conducting a cooling medium should be provided, especially in areas close to the boundary surface.

DETAILED DESCRIPTION OF THE PREFERRED EMBODIMENT

Figure 1:
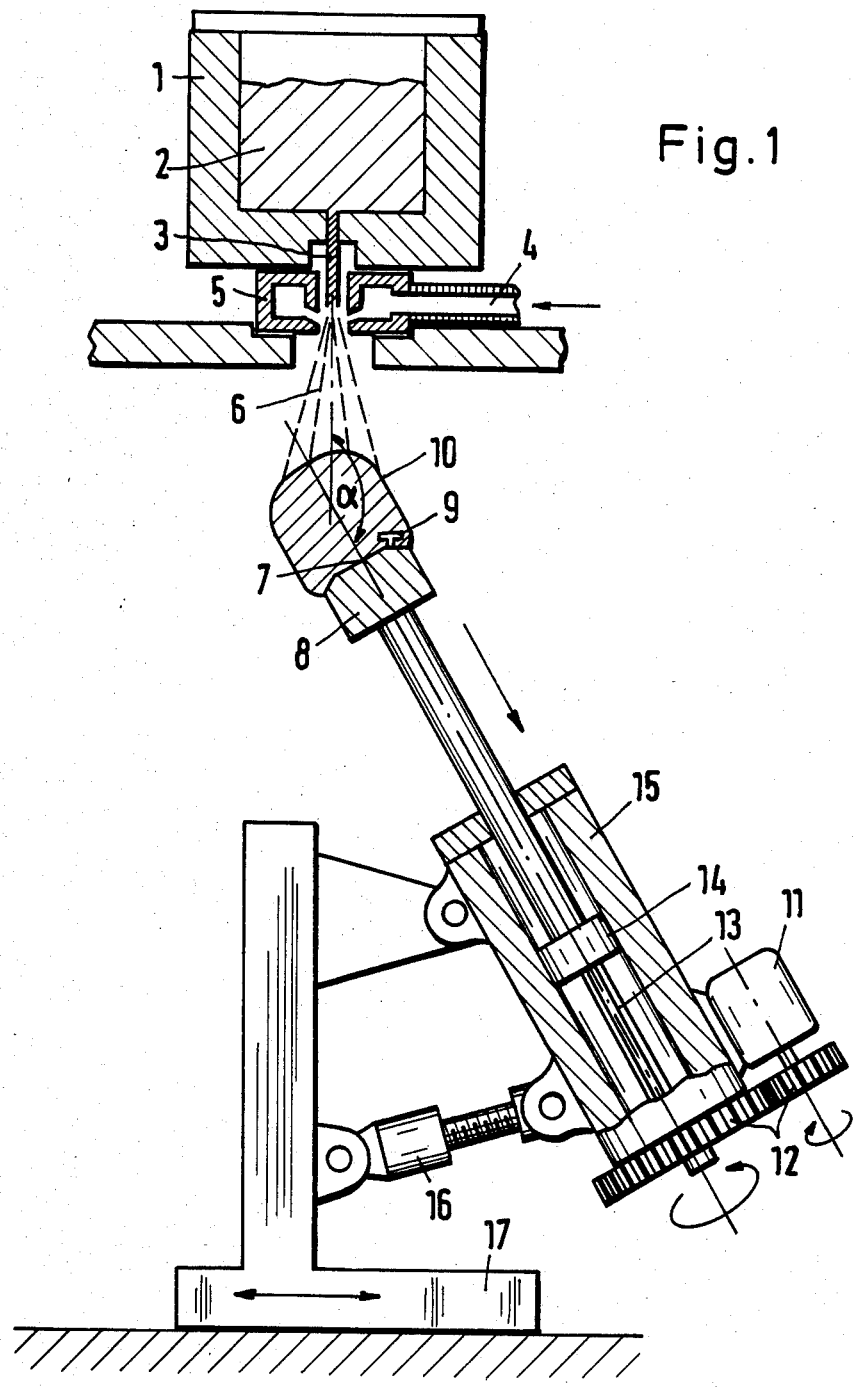
FIG. 1 is a section through a spray installation with a hydraulic removal device.

FIG. 1 shows the construction of a spray installation according to the invention. Pouring stream 3 of molten metal 2 flows from the tank of the molten metal 1 into the middle of ring-shaped spray nozle 5 and is sprayed by pressurized gas which flows through duct 4 into spray nozzle 5. The spray particles of resulting spray jet 6 are caught at the start of the spray process by catching surface 7 of dummy bar 8 whose head is replaceable. To obtain an interlocking connection, catching surface 7 is provided with several lugs 9. Dummy bar 8 is rotated around an axis of rotation extending through the center of catching surface 7 which is flat in this example. The dummy bar is simultaneously retracted (removed) downward in the direction of this axis of rotation to the extent that the length of ingot 10 formed from the caught spray particles grows, so that the distance of the catching surface i.e., the top of the ingot, from the spray nozzle remains constant. The shape of the outer surface of ingot 10 is formed without using an outside form (free forming).

The rotation of catching surface 7 is provided by a motor 11 and gears 12 and is transferred to piston 14 by splined shaft 13. Piston 14 is movable in a cylinder 15 and may be moved longitudinally by hydraulic pressure action within the cylinder. The angle $\alpha$ of the axis of rotation of catching surface 7 is set by swiveling mechanism 16. This entire catching device is mounted on a carriage 17 which can move transverse to the direction of spray.

Figure 2:
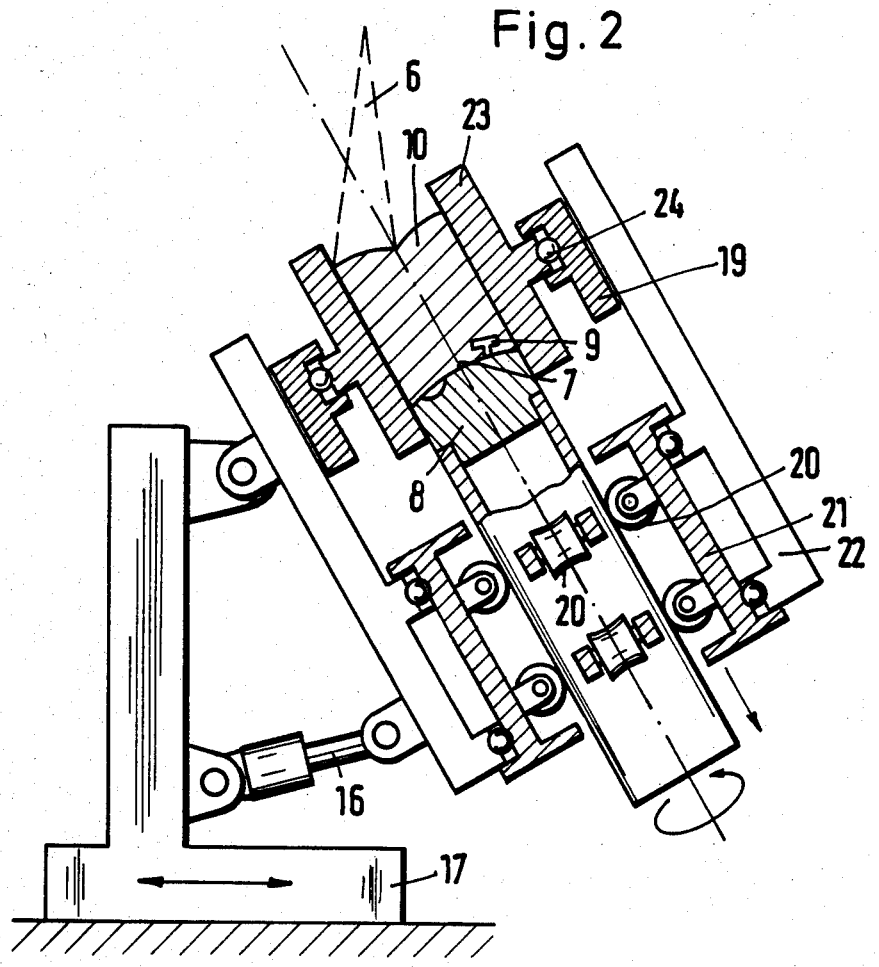
FIG. 2 is a section through a part of a spray installation with roller removal and a catching surface provided in boundary walls.

In the further embodiment of FIG. 2, a device is shown for the production of ingots of any length with any cross sectional form. Dummy bar 8, whose head is replaceable and whose cross section over its entire length corresponds to that of the ingot to be produced, is held by several rollers 20 pressed thereon by spring tension and driven by these rollers in a longitudinal direction.

Rollers 20 are themselves mounted in case 21 rotatably held in housing 22, the cage transmitting the movement of rotation to dummy bar 8. The drives for rollers 20, cage 21 and carriage 17 are not shown. In contrast to FIG. 1, this removal device does not have any limitation as regards the removable ingot length. A simultaneous rotary and longitudinal movement can also be achieved for ingots 10 if they possess a circular cross section by making the axes of driving rollers 20 pivotable and tilting them in relation to the longitudinal axis of dummy bar 8.

In FIG. 2, boundary surfaces (sleeve 23) are used for shaping the outer surfaces of the ingot. The particles of spray jet 6 are caught by catching surface 7 of dummy bar 8, which at the start of the spray process is in sleeve 23. This sleeve 23 determines the outside countour of ingot 10 and is rotatably mounted (e.g., by ball bearing 24) in a receptacle 19 in housing 22.

To prevent caking of the spray particles on the inside wall of sleeve 23, sleeve 23 is advantageously given a limited amplitude oscillating movement in the direction of the longitudinal axis of the dummy bar 8 by receptacle 19. The drive for this longitudinal movement is not shown. Apart from this oscillating movement, receptacle 19 is stationary in relation to housing 22. Dummy bar 8 performs rotary and longitudinal movement. It can have any cross section form, e.g., circle or square, and transmits its rotation movement to sleeve 23 which receives ingot 10. In case of an ingot with a circular cross section, a rotatable mounting of sleeve 23 is not required because such an ingot can also rotate within a stationary cylindrical sleeve 23.

Figure 3:
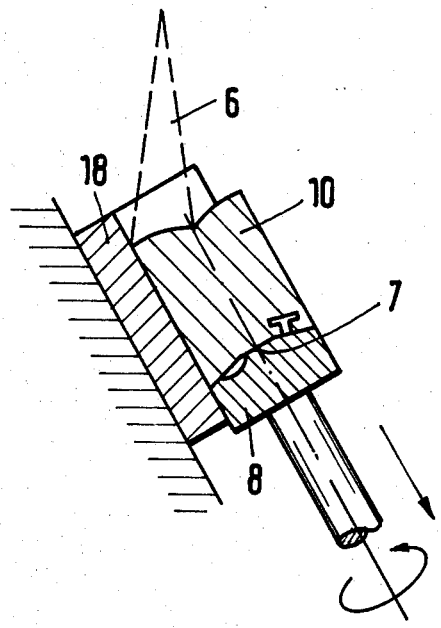
FIG. 3 is a section through a part of a spray installation with a catching surface provided in a cylinder covering section.

FIG. 3 shows an advantageous embodiment for the production of ingots with a circular cross section. In this case it suffices to use a sleeve 18 closed only in the impact area of spray jet 6 as a boundary surface for catching spray jet 6 and shaping ingot 10. The sleeve 18 has the shape of a partially hollow cylinder and is fixed relative to the rotary and longitudinal movement of dummy bar 8. Once again it can be advantageous to permit sleeve 18 to describe a limited oscillating movement around its stationary midposition, for example a longitudinal axial and/or rotary movement relative to the axis of rotation of dummy bar 8.

Figure 4:
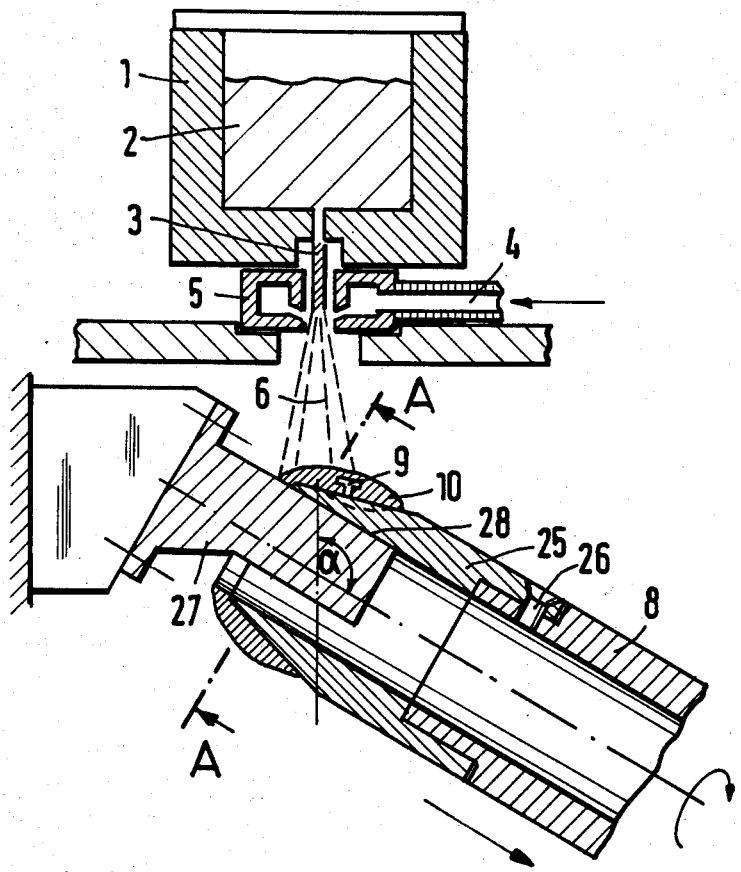
FIG. 4 is a section through an installation according to the invention for the production of cylindrical hollow ingots.
Figure 5:
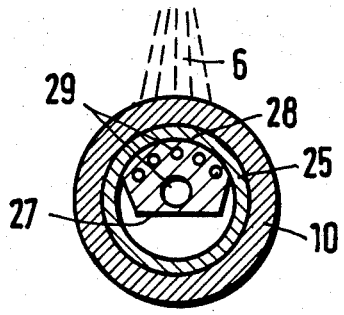
FIG. 5 is a section seen along to line A—A in FIG. 4.

FIG. 4 shows the essential components of a device according to the invention for the production of hollow ingots but without the removal device being shown. Spray device 1 through 5 corresponds to that in FIG. 1. Spray jet 6 strikes mandrel 27 positioned in a stationary manner below annular slot nozzle 5. Mandrel 27 has in the area facing spray jet 6, as appears from FIG. 5, a partially cylindrical surface 28. The cylindrical covering section of this cylinder viewed in cross section extends over an angle of about 135°. In the remaining area, mandrel 27 is made smaller than the imaginary cylinder belonging to its cylindrical partial covering surface 28.

Mandrel 27 whose axis can be set at an angle $\alpha$ with respect to the vertical with the aid of a device, not shown, has cooling ducts 29 passing therethrough, especially in the area near the surface. Removable head piece 25 is pressed onto mandrel 27 of a dummy bar 8 shaped as a cylindrical hollow shaft. Head piece 25 is fastened to hollow shaft 8 by a screw 26. Head piece 25 is conically beveled at its end area.

At the beginning of the spray process, spray jet 6 strikes the conical area of head piece 25 and there forms an ingot deposit 10. Deposit 10 adheres to head piece 25 and is there additionally firmly interlocked thereto by lug 9. During the entire spray process, deposit 10 is subject to a continuous helical movement (i.e., simultaneous rotational and axial downward movement). At the beginning of the process the deposit is moved axially by the removal device acting through dummy bar 8 and head piece 25. During the further course, the removal movement of newly sprayed deposit is accomplished by its adhesion to the already rigid part of the hollow cylinder which is being moved in a removal direction. Thus is developed a metallic hollow cylindrical ingot of "infinite" length. Owing to the shaping by surface 28, the inside surface of the ingot is comparatively smooth, while its outside surface is free-formed by spray jet 6 and therefore is rough.

Advantageously such a removal device used for the production of cylindrical hollow ingots, the removal movement can be regulated by disks, wheels or rollers, the setting of whose angle between axial movement and revolutions per minute can be adjusted. This adjustment is transferred to the agglomerate to be removed. The desired advance per revolution can be set by such an adjustment, while the speed of movement is set by adjusting the rotational speed of the dummy bar 8. With otherwise constant conditions, the latter is decisive for the resulting wall thickness of the hollow cylinder.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for forming an ingot having a length at least twice as great as a characteristic sectional dimension thereof, comprising the steps of:

spraying droplets of molten metal from spray means and in a first direction;

positioning an element having a catching surface in the path of said sprayed droplets;

providing a boundary surface adjacent said catching surface;

rotating said catching surface about an axis angularly spaced from said first direction by between 90° and 180°, whereby layers of said sprayed droplets are evenly applied to said catching surface to form a continuous agglomerate and, when said catching surface is covered by said agglomerate, said layers are evenly applied to a catching surface of said agglomerate; and continuously moving said agglomerate along said axis as said layers are applied and at a rate such that said catching surface remains at a constant distance from said spray means, whereby a longitudinal ingot surface is formed by said agglomerate layers.

2. The process of claim 1 including the step of moving said catching surface in an oscillating motion transverse to said first direction, whereby said layers are evenly applied over the entirety of said catching surface.

3. The process of claim 1 including the step of positioning said boundary surface to extend in the direction of said axis.

4. The process of claim 1 wherein for the production of an ingot having a circular section, said boundary surface is not rotated.

5. The process of claim 1 wherein for the production of a hollow ingot said boundary surface is a cylindrical portion of a mandrel inside said hollow ingot.

6. The process of claim 5 wherein said mandrel rotates about said axis.

7. The process of claim 6 wherein said mandrel is slightly conically shaped.

8. The process of claim 5 wherein said mandrel is not rotated.

9. The process of claim 3 wherein said boundary surface is positioned such that a portion of said sprayed droplets strikes said boundary surface.

10. The process of claim 5 wherein said mandrel is positioned such that a portion of said sprayed droplets strikes said boundary surface.

11. The process of claim 3 wherein said boundary surface is oscillated along said axis during said spraying step.

12. The process of claim 3 wherein said boundary surface is oscillated around said axis during said spraying step.

13. The process of claim 3 including the step of cooling said boundary surface.

14. The process of claim 1 wherein for the production of a solid ingot said boundary surface is outside of said ingot.

* * * * *